United States Patent [19]

Pryputniewicz et al.

[11] Patent Number: 4,572,599

[45] Date of Patent: Feb. 25, 1986

[54] WIPER FOR SLIDING ELECTRICAL CONTACT

[75] Inventors: Ryszard J. Pryputniewicz, Manchester, Conn.; John Clayton, Stow; Robert A. Waters, Weston, both of Mass.

[73] Assignee: Waters Manufacturing, Inc., Wayland, Mass.

[21] Appl. No.: 498,968

[22] Filed: May 27, 1983

[51] Int. Cl.[4] ..... H01R 39/18; H01C 1/12; H01C 10/32

[52] U.S. Cl. ..... 339/5 R; 339/5 M; 339/5 P; 338/171; 338/202

[58] Field of Search ..... 339/5 R, 5 A, 5 M, 5 P, 339/6 R, 6 A, 8 R, 8 A; 338/171, 202, 160, 170

[56] References Cited

U.S. PATENT DOCUMENTS

| | | | |
|---|---|---|---|
| 2,831,094 | 4/1958 | Bourns et al. | 338/202 X |
| 3,663,931 | 5/1972 | Brown | 339/258 R X |
| 3,906,429 | 9/1975 | Rhodes | 338/202 |
| 4,205,296 | 5/1980 | Frey, Jr. | 338/171 X |

*Primary Examiner*—Gil Weidenfeld
*Assistant Examiner*—Steven C. Bishop
*Attorney, Agent, or Firm*—Edgar H. Kent

[57] ABSTRACT

Wipers for sliding electrical contact have a form with gradual and progressive reduction in width and therfore decreasing stiffness and mass as they proceed towards the tip. This form results in higher resonant vibrational frequencies, enabling a wiper to follow the contact surface in high speed motion with less contact force. The lower contact force in turn produces less wiper distortion and consequently less hysteresis and wear.

13 Claims, 6 Drawing Figures

FIG 1
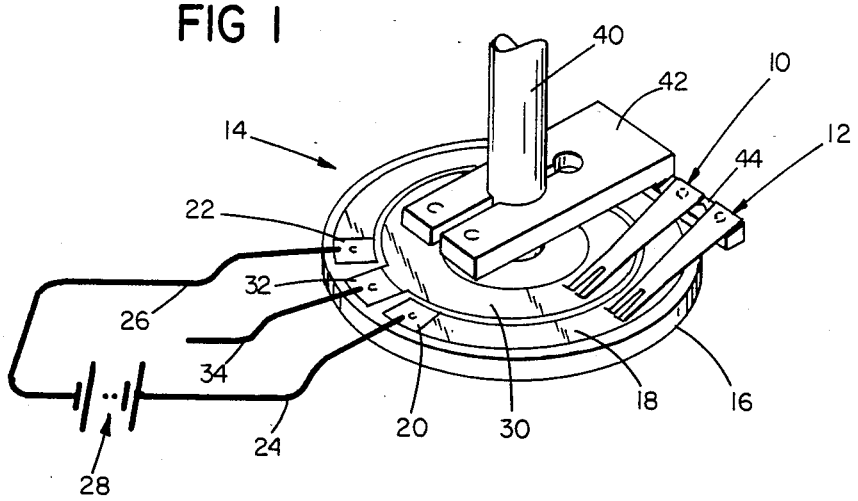
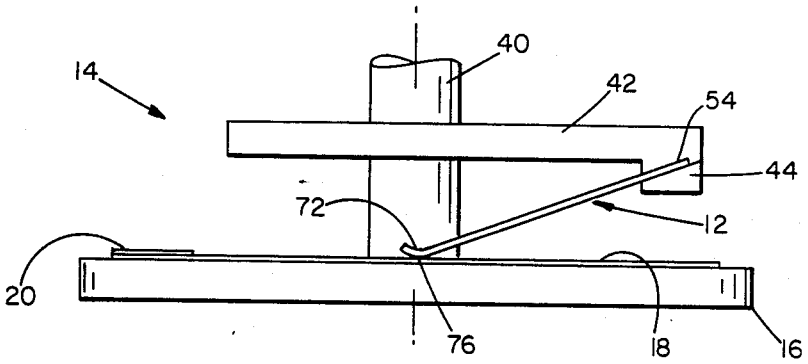
FIG 3
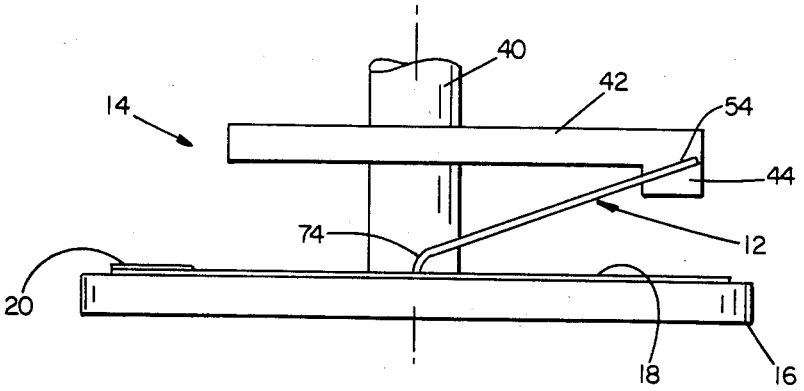
FIG 4

WIPER FOR SLIDING ELECTRICAL CONTACT

BACKGROUND OF THE INVENTION

The invention relates to potentiometers and the wipers used therein to make a sliding contact with an electrically conductive element.

Wipers used with conductive plastic resistance elements have conventionally followed a design developed for wipers used with the older, wire-wound resistor elements. Such wipers, used in position transducers, have been simply shaped elements made from metals chosen with regard to their static properties such as spring constant, electrical conductivity, corrosion resistance and wear resistance. Potentiometers are, in fact, transducers, i.e., devices that yield an electrical output for a given mechanical input, and the applications for such transducers are increasing. Potentiometers designed and manufactured using conventional wiper designs have serious inadequacies when used in high precision, high speed applications. In particular, the potentiometers displayed hysteresis in that the relationship between electrical and mechanical settings depends on the direction of most recent motion of the wiper, and this effect limited the precision of the potentiometer, especially with oscillating movement. Additionally, when the velocities and accelerations of wiper motion became large, there was intermittent interruption of the electrical contact between the wiper and the resistance element. The lifetime of such potentiometers used in automatic control circuits, especially where they are subject to frequent oscillating movement, has not been satisfactory because of high wear and wiper fatigue breakage in such service.

SUMMARY OF THE INVENTION

The general operation of potentiometers is well known, and the subject invention is directed toward novel shapes of the wipers which achieve significant improvement in potentiometer performance, particularly with respect to eliminating intermittent contact in high speed operation, improving accuracy by reducing hysteresis, and extending useful life of both the wiper and resistance element.

It has been found that in potentiometers which are used as transducers in service where the wiper is continually moved with respect to the electrical conductive element, flexing can be induced in the wiper which limits the potentiometer's performance. In particular, flexural vibrations can be induced and if the amplitude of such vibrations exceeds a certain level, the wiper contact will lift off the conductive surface, losing contact and generating apparent noise. Also, frictional forces tangential to the contact surfaces deform the wiper, the deformation being a function or direction and speed of the motion of the wiper relative to the conductive element, especially with oscillating motion. This variable deformation gives rise to hysteresis effects, wherein the voltage indication of the shaft position depends to some degree on the direction of motion of the shaft rather than solely on the true shaft position. The susceptibility to hysteresis and lift off increases with increasing operating speed. In general, increasing the force with which the wiper presses on the element reduces the tendency to lift off and generate noise, but increases the hysteresis effects and also reduces the useful life of the wiper by increasing wear.

It has been found that by giving the wiper of a potentiometer a form in which the cross section varies along the length, both the mass per unit length and the stiffness of the cross section (proportional to the second moment of the cross sectional area) can be varied in a controlled manner. By suitably varying the cross section, the resonant frequency of the wiper in flexure can be increased to a value above the frequencies present in the motions which the potentiometer experiences in any particular service, with the result that the wiper's resonances will not be excited and the tendency for the wiper to lift off the conductive element will be greatly reduced. Depending on the conditions of use for the potentiometer, the beneficial effects may be realized when the cross section of the wiper is varied so that the mass and moment of area decrease toward the distal, or contact end of the wiper. It has further been found that when the resonant frequency of the wiper has been raised above the exciting frequencies to which the potentiometer is subjected, it is possible to reduce the loading force with which the distal end of the wiper presses against the conductive element with the result that wear is reduced and potentiometer life is greatly extended.

It has also been found that variation of the wiper cross section can be used to greatly reduce hysteresis by progressively reducing the stiffness of the wiper towards the distal end.

BRIEF DESCRIPTION OF THE DRAWINGS

FIG. 1 shows, in perspective view, wipers according to the invention installed in a potentiometer.

FIG. 3 shows, in elevation view, the wiper of FIG. 2 in one of alternative contact positions.

FIG. 4 shows the wiper of FIG. 2 in a second of alternative contact positions.

DETAILED DESCRIPTION

Figure 2:
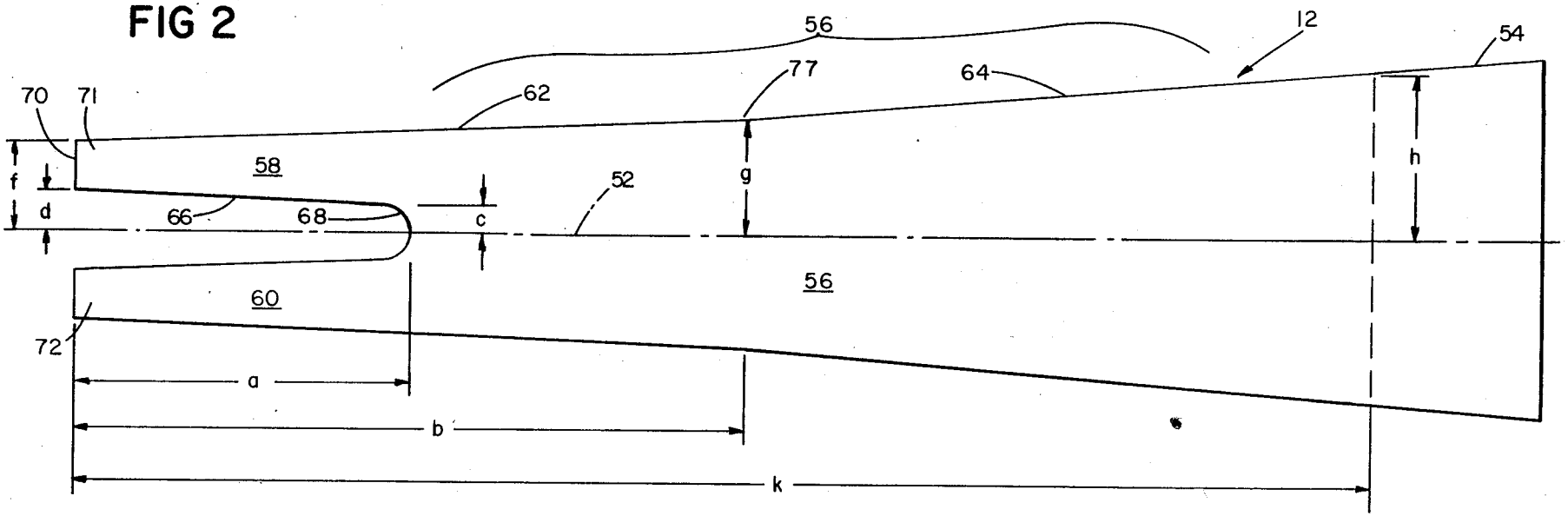
FIG. 2 shows, in plan view, a wiper of FIG. 1.

As shown in FIG. 1, wipers 10, 12, according to the invention, are assembled in potentiometer 14. Potentiometer 14 includes a base 16 supporting electrical resistance element 18 made of an electrical conductive plastic material deposited in the shape of a partial annulus. Resistance element 18 terminates on either end in terminal elements 20, 22 which are connected by way of leads 24, 26 to a source of voltage 28 (indicated schematically). Interior annulus 30, made of material with negligible electrical resistance, is supported on base 16 and connects to terminal element 32, to which lead 34 connects to provide an output voltage controlled by the setting of the potentiometer. Shaft 40 is supported to be rotatable with respect to base 16. Yoke 42 of non-conductive material is affixed to shaft 40 and supports wipers 10, 12, which are connected electrically by bridge element 44. Wipers 10, 12 are made of springy metal and are affixed to yoke 42 so that wiper 12 bears upon and makes electrical contact with resistance element 16 while wiper 10 bears upon and makes electrical contact with interior annulus 30.

As shown particularly in FIG. 2, a wiper 12 according to the invention is formed from a single continuous piece of flat stock of a springy electrically conductive material such as phosphor bronze, which may advantageously be 0.003 in. thick. Wiper 12 has bilateral symmetry about mid-line 52 and includes a base portion 54 for attachment to yoke 42, a body portion 56 connected at its proximal end to base portion 54, and two elongated finger portions 58, 60 connected at their proximal ends to the distal end of body portion 56. Lateral boundary of finger portion 58 is a straight line 62 angled away from mid-line 52 and extending proximally to a distance b from the distal end of finger 58 to become a lateral boundary of body portion 56. The lateral boundary of body portion 56 is continued as another straight line 64 angled more sharply away from mid-line 52. The boundaries 62 and 64 are connected by smooth transition radius 77. The medial boundary of finger portion 58 is a straight line 66 angled toward mid-line 52 as it extends proximally fairing into curve 68 which intersects mid-line 52 and continues smoothly as the boundary of finger portion 60. The distal end of finger portion is a straight line 70 perpendicular to mid-line 52.

Referring to FIG. 2, particular dimensions of wiper 12 (given in inches) may advantageously be: a=0.100; b=0.200; k=0.385; d=0.0115; f=0.0265; c=0.0075; g=0.034; h=0.048.

It may be particularly noted that wiper 12 has a smoothly shaped form with the finger portions 58, 60 fairing smoothly into body portion 56 without abrupt transitions or sharp corners, which have been found to cause stress raisers limiting the life of a wiper.

As seen particularly in FIGS. 3 and 4, the distal ends 71 and 72 of finger portions 58 and 60 respectively are bent slightly out of the plane of the body 56 to form convex surfaces 74, 76. Wiper 12 may be mounted on yoke 42 in alternative positions. In the first of these (shown in FIG. 3) the convex surface makes contact with conductive element 16, while in the second position (shown in FIG. 4) the wiper makes contact at the edge at the extreme distal end of the fingers. Each of the contact configurations has been found to have advantages in certain circumstances, the edge contact providing better resolution where the conductive element is uniformly smooth while the bend contact is preferred where the fingers must cross a seam as at a boundary between one conductive element and another. The form of the wiper shown advantageously provides a bi-positional wiper that can be mounted for either service, thereby reducing manufacturing and stocking expenses.

Figure 5:
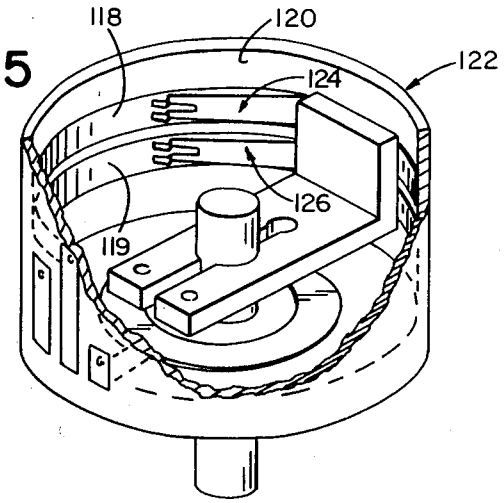
FIG. 5 shows an alternative potentiometer construction using wipers according to the invention.

In FIG. 5 an alternative potentiometer design is shown in which resistance element 118 and electrically conductive strip 119 are deposited on the interior surface of shell 120 of potentiometer 122. Wipers 124 and 126, similar in shape to the wipers previously described are mounted on rotatable shaft 128 to contact resistance element 118 and conductive strip 119 respectively.

Figure 6:
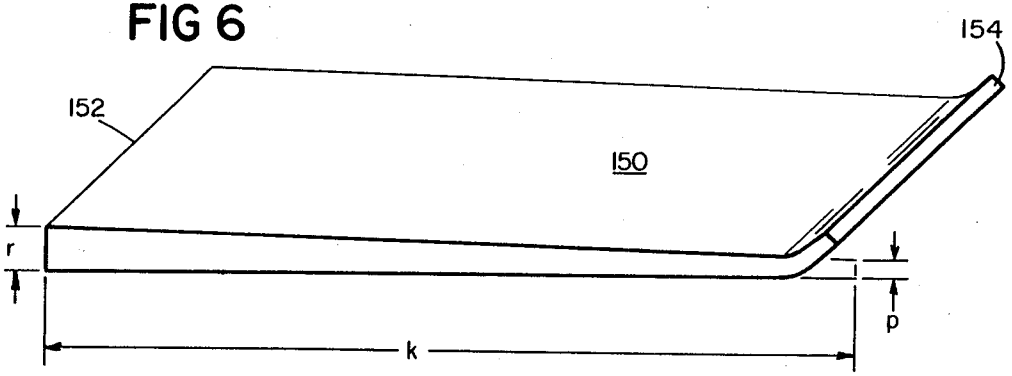
FIG. 6 shows a wiper having an alternative shape.

A wiper of alternative shape is shown in FIG. 6. Wiper 150 has a continuously varying thickness, decreasing from its proximal end to its distal end. The thickness r at the proximal end may advantageously be 0.0035 in. with the thickness p at the distal end 0.0025 in.

The superior performance of potentiometers fitted with wipers according to the invention is shown by tests in which the operation of potentiometers fitted with wipers of conventional design (cross-sections of uniform width terminating in finger portions of uniform width) was compared with operation of potentiometers fitted with wipers as shown in FIG. 2 with dimensions as noted above. The compared potentiometers were operated in an oscillatory motion. The maximum frequency at which conventional wipers were able to perform without producing objectional noise from breaking contact was 30 Hz, while wipers according to the invention as described above were able to perform at frequencies in excess of 80 Hz.

In further tests, the compared wipers were tested for linear hysteresis. The conventional wipers properly adjusted showed a hysteresis of 0.000 60 inches in a standard test, while wipers according to the invention in similar test conditions showed a hysteresis of less than 0.000 02 inches. In a rotational hysteresis test, conventional potentiometers fitted with conventional wipers showed a hysteresis of 0.08 degrees, while potentiometers fitted with wipers according to the invention showed a hysteresis less than 0.01 degrees.

In a comparative life test, potentiometers using wipers according to the invention operated for over 200,000,000 cycles. In comparison it has been unusual for potentiometers using conventional wipers to have a life greater than 25,000,000 cycles.

It will be recognized that the invention is not limited to the specific shape of wiper illustrated but may be modified within the spirit thereof in ways which will be readily apparent to those skilled in the art.

What is claimed is:

1. A wiper for making a sliding electrical contact with an electrically conductive material, said wiper being formed from a single continuous piece of electrically conductive and resiliently deformable material, and having a generally elongated shape, said wiper including a base portion at one end for attachment to mechanism for moving the wiper relative to said electrically conductive material, a body portion attached to said base portion at its proximal end, and a plurality of finger portions attached to the distal end of said body portion at their proximal ends and making contact with said conductive material at their distal ends, the improvement wherein the cross sectional area of said body element decreases continuously from its proximal toward its distal end, and the cross sectional area of each of said fingers changes continuously from its proximal towards its distal end.

2. A wiper as claimed in claim 1, wherein said wiper has two fingers and is bilaterally symmetric around a mid-line, and the lateral boundary of each finger is formed by a line diverging progessively from said mid-line in the proximal direction and extending proximally to form part at least of the boundary of said body.

3. A wiper as claimed in claim 2, wherein said fingers are connected to said body through smooth transitions excluding abrupt changes in cross section.

4. A wiper of generally elongated form formed from a single continuous piece of electrically conductive and resiliently deformable material for making sliding electrical contact with an electrically conductive material, said wiper having bilateral symmetry about a mid-line, and including a base portion for attachment to means for moving said wiper, a body portion connected to said base portion at its proximal end, and two finger portions attached at their proximal ends to the distal end of said body portion, the lateral boundaries of said finger portions being straight lines extending proximally to become boundaries of said body portion, a part of said body portion adjacent to said base portion having a straight line boundary diverging proximally more sharply from said mid-line than said finger portion lateral boundary straight line, the medial boundaries of said finger portions including straight lines sloping in the proximal direction toward said mid-line, and terminating in a smooth transition curve joining the proximal ends of said finger portions.

5. Apparatus as claimed in claims 1, 2, 3, or 4, wherein the distal ends of said finger portions have a bend out of the plane of said body portion, thereby forming a bi-positional wiper assemblable without modification in a first orientation to contact an electrical material at a convex surface of said bend or in a second orientation to contact an electrical material at a sharp edge at the extreme distal end of said finger portions.

6. In a potentiometer containing an electrical conductive element and a wiper with a proximal end affixed to a structure for moving said wiper and a distal end making sliding contact with said electrical conductive element, said potentiometer being for use in operations where the wiper is continually moved with respect to the electrical conductive element and an electrical output from the potentiometer is used to provide an indication of such motion, the frequency spectrum of the motion between the wiper and the electrical conductive element lying below a value F, the improvement wherein the wiper is shaped to have a fundamental resonant frequency in flexing oscillations substantially greater than F.

7. Apparatus as claimed in claim 6, wherein said wiper is loaded against said electrical conductive element with a force not greater than necessary to prevent lift-off, whereby the wear between said wiper and said electrical conductive element is reduced and the usable life of said potentiometer is increased.

8. Apparatus as claimed in claim 6, wherein said wiper has a varying cross section the area thereof diminishing towards said distal end.

9. Apparatus as claimed in claim 8, wherein the second moment of area of said varying cross section diminishes toward said distal end.

10. Apparatus as claimed in claims 1, 4 or 8, wherein said wiper has uniform thickness.

11. Apparatus as claimed in claim 8, wherein said wiper has a continuous varying thickness.

12. In a potentiometer containing a wiper with a proximal end affixed to a structure for moving said wiper and a distal end making sliding contact with an electrically conductive element, the improvement wherein said wiper has a varying cross section, the second moment of area of said varying cross section diminishing toward said distal end, whereby the linear hysteresis in said potentiometer is reduced to a value less than 0.0001 inches.

13. In a potentiometer attached to a shaft to provide an electrical indication of the position thereof and containing a wiper with a proximal end affixed to a structure for moving said wiper and a distal end making sliding contact with an electrical conductive element, the improvement wherein said wiper has a varying cross section, the second moment of area of said varying cross section diminishing toward said distal end, whereby the angular hysteresis in said potentiometer is reduced to a value less than 0.03 degrees.

* * * * *